US007228093B2

(12) United States Patent
Sakai et al.

(10) Patent No.: US 7,228,093 B2
(45) Date of Patent: Jun. 5, 2007

(54) METHOD AND APPARATUS FOR IMAGE FORMING CAPABLE OF PERFORMING A STABLE IMAGE DEVELOPMENT

(75) Inventors: Kiyotaka Sakai, Kawasaki (JP); Hideo Yoshizawa, Saitama (JP); Katsumi Masuda, Edogawa-ku (JP); Hideki Kimura, Kawasaki (JP); Tsuyoshi Imamura, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 11/153,538

(22) Filed: Jun. 16, 2005

(65) Prior Publication Data

US 2005/0281589 A1 Dec. 22, 2005

(30) Foreign Application Priority Data

Jun. 16, 2004 (JP) ..... 2004-178308

(51) Int. Cl.
*G03G 15/08* (2006.01)

(52) U.S. Cl. ..... 399/254; 399/120; 399/256

(58) Field of Classification Search ..... 399/120, 399/254, 256

See application file for complete search history.

(56) References Cited

U.S. PATENT DOCUMENTS 5,655,193 A * 8/1997 Fujishiro et al. ..... 399/256
5,794,108 A 8/1998 Yoshizawa et al.
5,970,290 A 10/1999 Yoshiki et al.
6,421,516 B1 * 7/2002 Kinoshita et al. ..... 399/256
6,987,940 B2 * 1/2006 Tamura ..... 399/227

FOREIGN PATENT DOCUMENTS

JP 2001-215780 8/2001

OTHER PUBLICATIONS

U.S. Appl. No. 11/353,119, filed Feb. 14, 2006, Imamura.

* cited by examiner

*Primary Examiner*—David M. Gray
*Assistant Examiner*—Joseph S. Wong
(74) *Attorney, Agent, or Firm*—Oblon, Spivak, McClelland, Maier & Neustadt, P.C.

(57) ABSTRACT

An image forming method and apparatus includes a development device in which two rotary shafts enclosed in respective separate chambers for spirally circulating the developer between the two chambers to supply the developer to a development roller. The development device is provided with an extended circulation enclosure having a fill opening communicating with the two chambers.

9 Claims, 4 Drawing Sheets

METHOD AND APPARATUS FOR IMAGE FORMING CAPABLE OF PERFORMING A STABLE IMAGE DEVELOPMENT

BACKGROUND OF THE INVENTION

1. Field of the Invention

The present invention relates to a method and apparatus for image forming, and more particularly to a method and apparatus for image forming that is capable of performing a stable image development.

2. Discussion of the Background

Conventional image forming apparatuses form an electrostatic latent image and develop it into a toner image using a developer including toner. In the development process, the developer needs to be transported from a container to a surface of a development roller which supplies the developer to the electrostatic latent image, thereby forming a toner image. For the transportation of the developer to the development roller, two rotary transportation members are typically used. One of the members transports the developer along the surface of the development roller from one end to the other end of the surface of the development roller in an axis direction of the development roller. Consequently, the developer is primarily supplied to the surface of the development roller and a great part of the developer amount is transported to the other end of the surface of the development roller. The other rotary transportation member transports the developer in the reverse direction along the surface of the development roller so that the developer is sufficiently circulated.

In the above-described development mechanism, however, a part of the transported developer tends to stay and to build up at a place out of the end of the development roller without being used for development.

SUMMARY OF THE INVENTION

This patent specification describes a novel image forming apparatus which improves an image quality by reducing an occurrence of uneven toner density. In one example, a novel image forming apparatus includes a photoconductive member and a development device. The photoconductive member is configured to carry an electrostatic latent image thereon. The development device is configured to develop the electrostatic latent image formed on the photoconductive member into a visual image with a developer. The development device includes a main housing, an extended housing, a development roller, and first and second rotary shafts. The main housing has first and second side frames facing each other and a first partition for longitudinally dividing an inside space into first and second chambers communicating with each other through first and second openings formed in the first partition near the first and second side frames, respectively. The extended housing is connected to the first side frame of the main housing and has an extension side frame distantly facing the first side frame of the main housing and a second partition continuously formed in line with the first partition for making the first and second chambers of the main housing extended with an extension opening in the second partition near the extension side frame for communicating to the first and second chambers. The development roller has first and second ends held by the first and second side frames, respectively. The first rotary shaft has an extended length held by the first and second side frames and the extension side frame, is arranged in parallel to and immediately next to the development roller, and is configured to rotate to transport the developer along a longitudinal surface of the development roller in a first direction from the second end to the first end of the development roller and to the second chamber through the first opening and the extension opening. The second rotary shaft has an extended length held by the first and second side frames and the extension side frame, is arranged in parallel to and next to the development roller via the first rotary shaft, and is configured to rotate to transport the developer in a second direction opposite to the first direction and to the first chamber through the second opening.

The first opening may be smaller than the extension opening.

The extended housing may include a fill opening arranged at an extended position extended outside from the first opening of the main housing and is configured to communicate with the first and second chambers and to fill the developer.

Each of the first and second rotary shafts may include a spiral wing for transporting the developer.

This patent specification further describes a novel image developing apparatus which develops an electrostatic latent image formed on a photoconductive member into a visual image with a developer in an image forming apparatus. The development device includes a main housing, an extended housing, a development roller, and first and second rotary shafts. The main housing has first and second side frames facing each other and a first partition for longitudinally dividing an inside space into first and second chambers communicating with each other through first and second openings formed in the first partition near the first and second side frames, respectively. The extended housing is connected to the first side frame of the main housing and has an extension side frame distantly facing the first side frame of the main housing and a second partition continuously formed in line with the first partition for making the first and second chambers of the main housing extended with an extension opening in the second partition near the extension side frame for communicating to the first and second chambers. The development roller has first and second ends held by the first and second side frames, respectively. The first rotary shaft has an extended length held by the first and second side frames and the extension side frame, is arranged in parallel to and immediately next to the development roller, and is configured to rotate to transport the developer along a longitudinal surface of the development roller in a first direction from the second end to the first end of the development roller and to the second chamber through the first opening and the extension opening. The second rotary shaft has an extended length held by the first and second side frames and the extension side frame, is arranged in parallel to and next to the development roller via the first rotary shaft, and is configured to rotate to transport the developer in a second direction opposite to the first direction and to the first chamber through the second opening.

This patent specification further describes a novel image forming method used in an image forming apparatus which develops an electrostatic latent image formed on a photoconductive member into a visual image with a developer in an image forming apparatus. In one example, a novel method includes the steps of rotating, circulating, bypassing, and adding. The rotating step rotates a development roller having first and second longitudinal ends. The circulating step circulates a developer with first and second rotary wing shafts through a main circulating loop having a first passage directly facing a circumferential surface of the development roller and a second passage isolated from the first passage by a first partition. The first passage has a first upstream area arranged in a vicinity of the first end of the development roller and a first downstream area arranged in a vicinity of the second end of the development roller. The second passage has a second upstream area and a second downstream area. The first and second passages communicate with each other between the first upstream area and the second downstream area and between the first downstream area and the second upstream area. The circulating step comprising sub-steps of transporting and returning. The transporting step transports the developer with the first rotary wing shaft from the first upstream area to the first downstream area through the first passage. The returning step returns the developer with the second rotary wing shaft from the second upstream area to the second downstream area through the second passage. The bypassing step bypasses the developer through a bypass loop with extended portions of the first and second rotary wing shafts extended respectively in line in an outward direction from the second end of the development roller from the first downstream area to the second upstream via a returning area of the bypass loop. The adding-step adds the developer into the bypass loop through the returning area.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
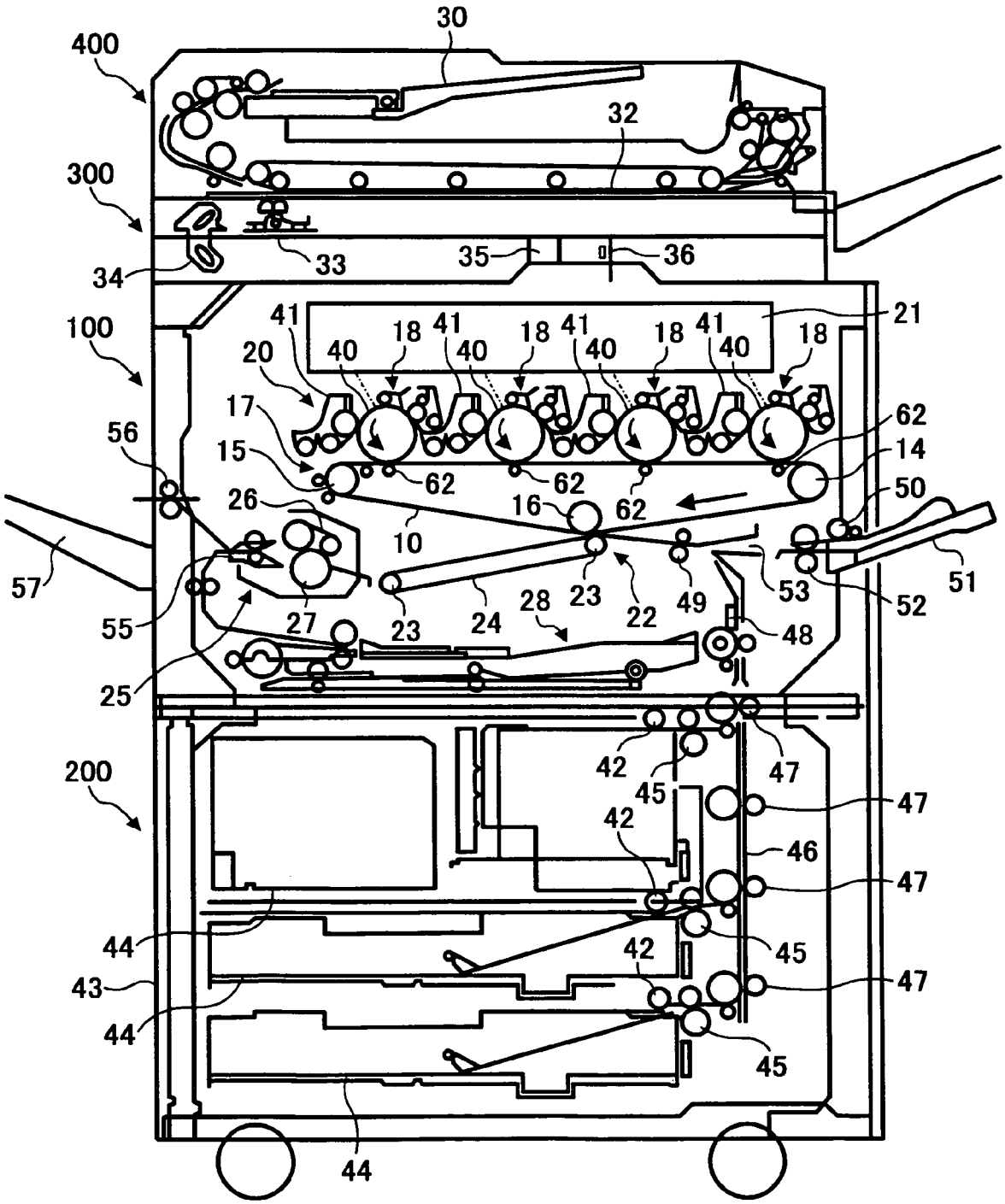
FIG. 1 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to a preferred embodiment of the present invention is described. The image forming apparatus illustrated in FIG. 1 is a color copying machine using a tandem type development system, as one example. The image forming apparatus forms a color image on a recording sheet with black, yellow, magenta, and cyan color toners, and applies two-component type developer including toner and carrier to an image development. As shown in FIG. 1, the image forming apparatus includes an image forming unit 100, a sheet cassette table 200, a scanner 300, and an automatic document feeder (ADF) 400.

The image forming unit 100 includes an intermediate transfer member 10 which is formed in an endless belt shape and is provided at an approximately center of the image forming unit 100. The intermediate transfer member 10 includes a base layer made of materials including a less-extensible fluorocarbon resin or a less-extensible muslin with extensible rubber material, for example. The intermediate transfer member 10 further includes an elastic layer which overlays the base layer. The elastic layer includes a fluorocarbon rubber or acrylonitrile-butadiene copolymer rubber, for example. The surface of the elastic layer is coated with a fluorocarbon resin, for example, thereby forming a smooth-surface coat layer.

The intermediate transfer member 10, as illustrated in FIG. 1, is extended among rollers 14, 15, and 16 for rotation in a clockwise direction indicated by an arrow.

The image forming unit 100 is provided with a cleaning device 17 for removing the residual developer after the development process from the surface of the intermediate transfer member 10. As one example, the cleaning device 17 is disposed at a place next to the roller 15.

The image forming unit 100 is further provided with four image forming mechanisms 18 for yellow, cyan, magenta, and black color toners, laid in line on a straight portion of the intermediate transfer member 10 extended between the rollers 14 and 15 in a moving direction of the intermediate transfer member 10. This arrangement of the four image forming mechanisms 18 is referred to as a tandem layout, and reference numeral 20 of FIG. 1 denotes a tandem image forming unit. Over such a tandem image forming unit 20, an optical unit 21 is installed.

Each one of the image forming mechanisms 18 includes a photoconductor 40 and various associated components such as, a charging device (not shown), a development device 41, a primary transfer device 62, a photoconductor cleaning device (not shown), and a discharging device (not shown), for example. These components are disposed around the photoconductor 40.

The image forming unit 100 is further provided with a secondary transfer device 22 disposed opposite to the tandem image forming unit 20 relative to the intermediate transfer member 10. As shown in FIG. 1, the secondary transfer device 22 includes a belt 24 extended between two rollers 23. One of the rollers 23 is disposed close to the roller 16. The secondary transfer device 22 is caused to operate such that the belt 24 pushes the roller 16 via the intermediate transfer member 10, thereby transferring a toner image carried by the intermediate transfer member 10 to a recording sheet.

The image forming unit 100 is further provided with a fixing device 25 disposed next to the secondary transfer device 22 for fixing a transferred image held on a recording sheet transported from the sheet cassette table 200. The fixing device 25 has a structure in which a pressure roller 27 is held in contact with an endless rotary fixing belt 26 under pressure.

The secondary transfer device 22 has, in addition to the above-described image transfer function, a transportation function for transporting the recording sheet to the fixing device 25. Although the image transfer function can be achieved by an alternative mechanism such as a transfer roller, a non-contact type charger, or the like, it would be difficult for such an alternative mechanism to carry out also the transportation function.

The image forming unit 100 is further provided with a sheet turnover device 28 placed under the secondary transfer device 22 and the fixing device 25 and in parallel with the tandem image forming unit 20. The sheet turnover device 28 turns the recording sheet to allow a duplex print for print on both sides of the recording sheet.

To make a copy of an original with the above-described image forming apparatus, the original is placed on an input tray 30 of the ADF 400. As an alternative way, the original can be set directly on a contact glass 32 of the scanner 300 by lifting up the ADF 400 to a preparatory position and is held by lowering the ADF 400 to a set position.

Upon a depression of a start key (not shown), the original placed on the input tray 30 is transported to the contact glass 32. Then, the scanner 300 is started to move first and second sliding members 33 and 34.

When the original is set directly on the contact glass 32, the scanner 300 is immediately started to move the first and second sliding members 33 and 34 upon a depression of the start key.

The first sliding member 33 irradiates light from a light source (not shown), receives with a mirror (not shown) the light reflected by the original and further reflects the light towards a mirror (not shown) of the second sliding member 34. The light is then reflected by the second sliding member 34 towards a sensor 36 through an imaging lens 35. Thus, the original is read and image data is obtained.

In parallel to the above-described operations, upon the depression of the start key, one of the rollers 14-16, which is a drive roller, is started to be driven to rotate the intermediate transfer member 10 with the remaining two of the rollers 14-16, which are free rollers. At the same time, the photoconductive members 40 of the image forming devices 18 are started to be rotated in a counterclockwise direction as indicated in FIG. 1.

The image data read from the original is, after execution of various signal processing, converted via an image modulation into laser light beams representing black, yellow, magenta, and cyan color image signals. The laser light beams are emitted to the photoconductive members 40 to form respective electrostatic latent images in black, yellow, magenta, and cyan colors. Then, the development devices 41 which contain the two-component type developer develop the respective electrostatic latent images with the black, yellow, magenta, and cyan color toners into black, yellow, magenta, and cyan color toner images, respectively. These color toner images are sequentially transferred onto the intermediate transfer member 10 so as to overlay one on another to form them into a single synthetic color image, as the intermediate transfer member 10 rotates.

Further, in parallel to the above-described operations, upon the depression of the start key, one of pickup rollers 42 of the sheet cassette table 200 is selected and is driven so as to move an uppermost recording sheet towards a separation roller 45 in a corresponding one of sheet cassettes 44 contained in a sheet bank 43. At this time, a few recording sheets may be moved together with the uppermost recording sheet due to a friction force. The separation roller 45 separates the uppermost recording sheet from the rest and feeds it into a sheet transportation passage 46. The recording sheet guided into the sheet transportation passage 46 is further forwarded by a plurality of feed rollers 47 into a sheet transportation passage 48 disposed in the image forming unit 100. Through the sheet transportation passage 48, the recording sheet is moved to a registration roller 49 and is then temporarily stopped by the registration roller 49.

Alternatively, a recording sheet can be inserted into the image forming unit 100 manually from an auxiliary input tray 51. In this case, upon the depression of the start key, a feed roller 50 is started to be driven to transfer the recording sheet placed on the auxiliary input tray 51 towards a separation roller 52. As in the case of feeding from the sheet cassette, a few recording sheets may be moved together with an uppermost recording sheet when a number of sheets are placed. Then, the separation roll 52 separates and feeds further the uppermost recording sheet to the registration roller 49.

The registration roller 49 which is stopping the recording sheet is started to be driven to restart the transportation of the recording sheet in synchronism with a movement of the synthetic color toner image carried on the intermediate transfer member 10. The recording sheet is inserted between the intermediate transfer member 10 and the secondary transfer device 22. As the recording sheet is advanced in contact with the intermediate transfer member 10, the synthetic color toner image is transferred from the intermediate transfer member 10 onto the recording sheet by an action of the secondary transfer device 22.

After the image transfer process, the secondary transfer device 22 further transports the recording sheet to the fixing device 25. The fixing device 25 fixes the color toner image onto the recording sheet with heat and pressure. Then, the recording sheet having the fixed color toner image thereon is forwarded to an ejection roller 56 via a switch pawl 55 and is ejected to an output tray 57 by the ejection roller 56. When the switch pawl 55 is set to a duplex position, the recording sheet is guided to a different passage so as to be forwarded to the sheet turnover device 28. The sheet turnover device 28 turns the recording sheet so that a blank surface of the recording sheet is to face the intermediate transfer member 10 during a second image forming process. Then, the reversed recording sheet is transported again to the registration roller 49 for the second image forming process. After the second image forming process, the recording sheet having images on the both sides is caused to pass through the fixing device 25 and is ejected via the switch pawl 55 and the ejection roller 56 to the output tray 57.

During the secondary image transfer, it is possible that some toner particles are not transferred and remain on the intermediate transfer member 10 even after the secondary image transfer. The cleaning device 17 removes these residual toner particles from the surface of the intermediate transfer member 10. Thus, the tandem image forming unit 20 becomes ready for the next image forming process.

The registration roller 49 may possibly be connected to a bias voltage to remove dust of the recording sheets, although the registration roller 49 is generally grounded.

Figure 2:
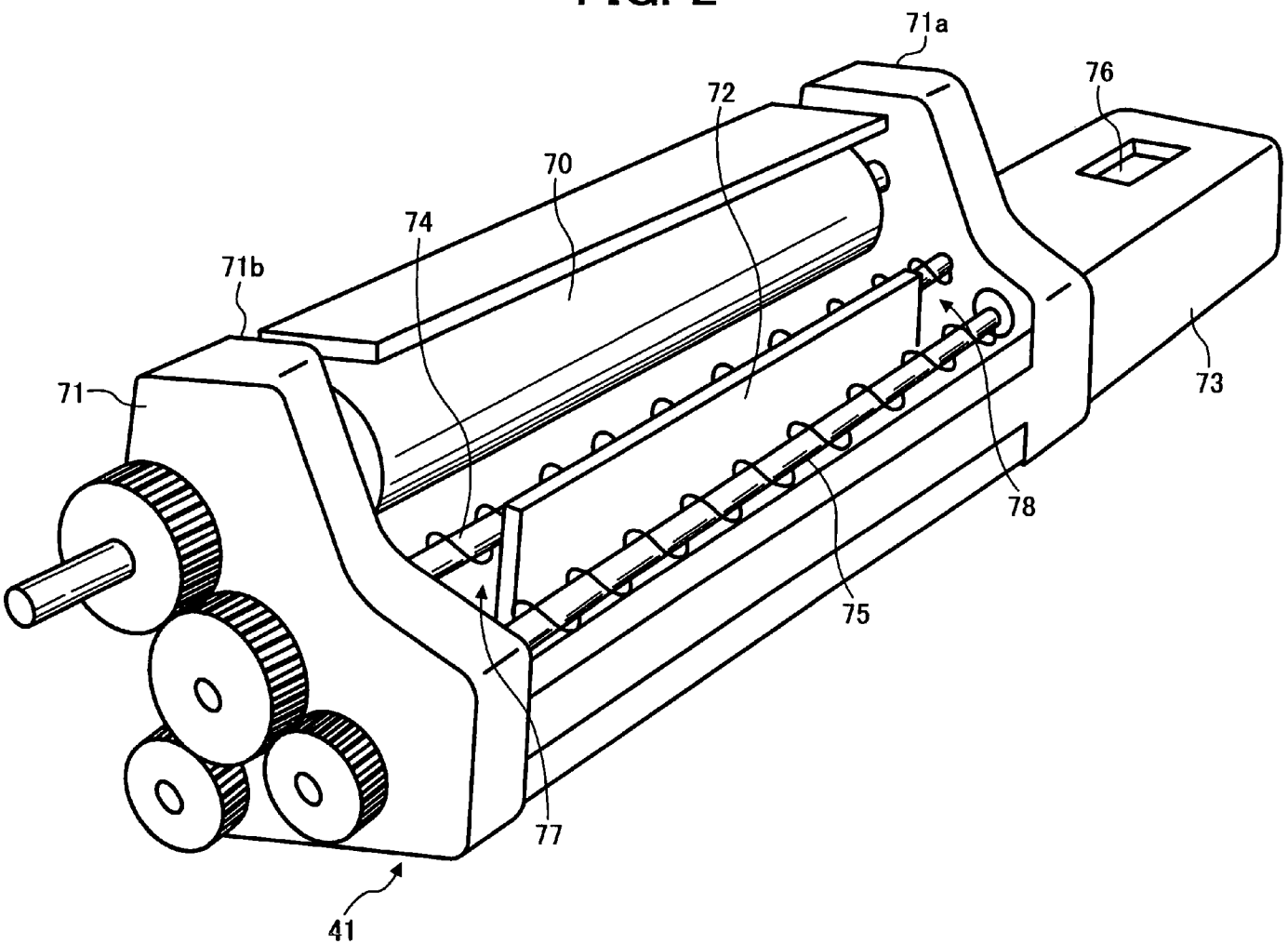
FIG. 2 is a diagrammatic perspective view of a development unit included in the image forming apparatus of FIG. 1.
Figure 3:
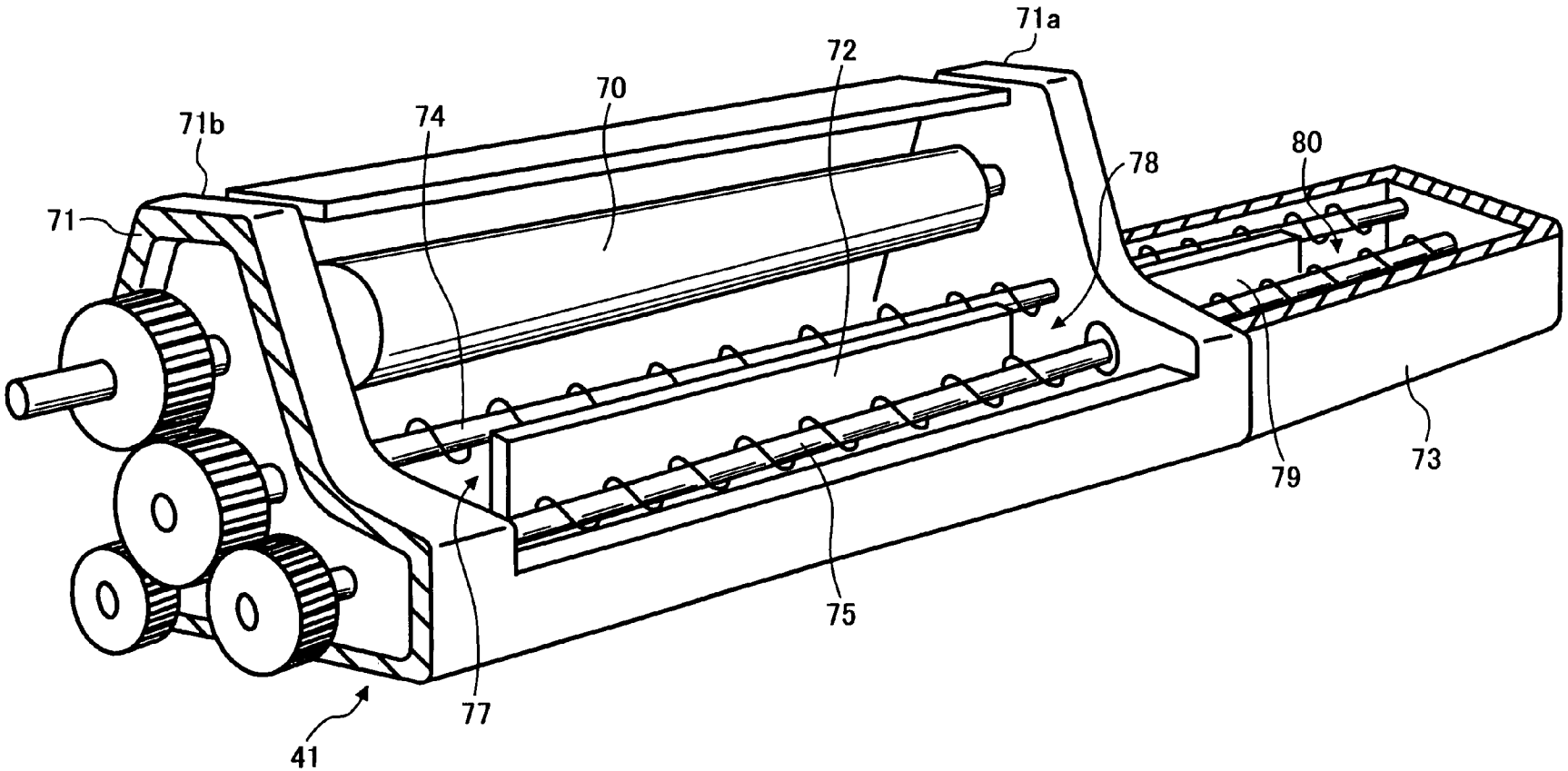
FIG. 3 is another diagrammatic perspective view of the development unit with a housing partly in cross section.

Referring to FIGS. 2-5, the development device 41 is explained. As illustrated in FIGS. 2 and 3, the development device 41 includes a development roller 70, a housing 71, a first partition wall 72, an extended portion 73, a first rotary shaft 74, and a second rotary shaft 75. The development device 41 further includes a fill opening 76, a pass-through opening 77, a first circulation opening 78, a second partition wall 79, and a second circulation opening 80. The housing 71 includes a first side portion 71*a* and a second side portion 71*b*. The partition 72 is disposed between the first and second rotary shafts 74 and 75. The extended portion 73 is extended outward from the first side portion 71*a*. The first and second rotary shafts 74 and 75 have a length across the housing 71 and the extended portion 73 and are provided with a spirally-formed screw. The first rotary shaft 74 is arranged immediately next to the development roller 70, and the second rotary shaft 75 is arranged opposite to the development roller 70 relative to the first rotary shaft 74. The fill opening 76 is formed in the extended portion 73. The pass-through opening 77 is formed between the second side portion 71*a* and one vertical side edge of the first partition 72. The first circulation opening 78 is formed between the first side portion 71*b* and the other vertical side edge of the first partition 72. The second partition 79 is provided inside the extended portion 73. The second circulation opening 80 is formed inside the extended portion 73 at an area opposite from the first side portion 71*a* relative to a vertical edge of the second partition 79.

Figure 4:
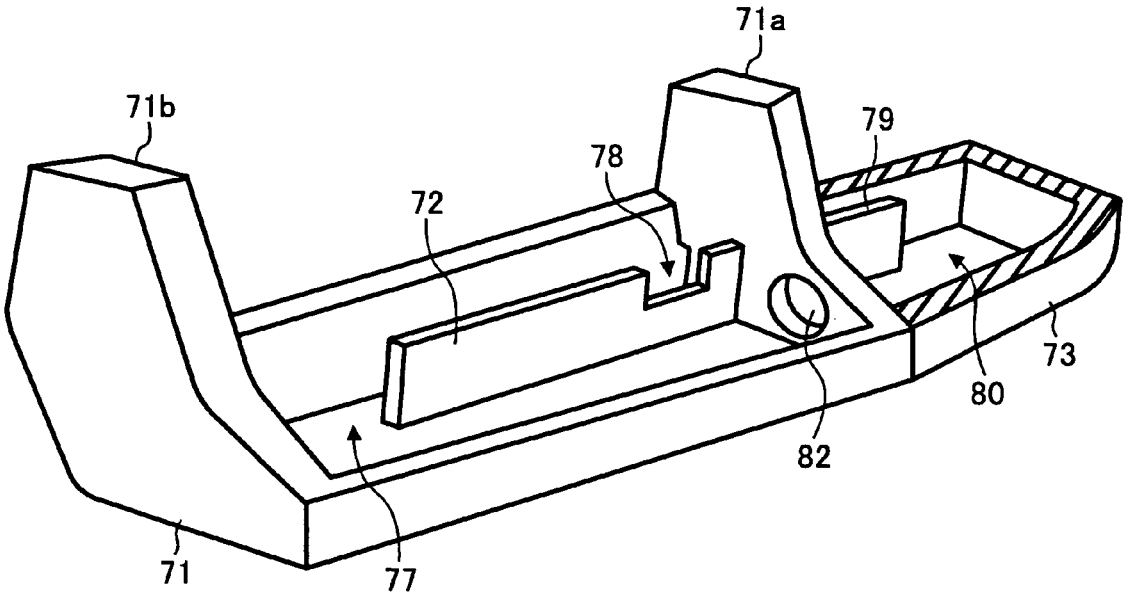
FIG. 4 is a diagrammatic perspective view of the housing of FIG. 3.

As illustrated in FIG. 4, the first partition 72 is configured to stand on a bottom and in an approximate middle part of the housing 71 to divide an inside space of the housing 71 in a longitudinal direction. The second partition 79 is configured to continue in line with the first partition 72 so as to divide an inside space of the extended portion 73 in the longitudinal direction.

Figure 5:
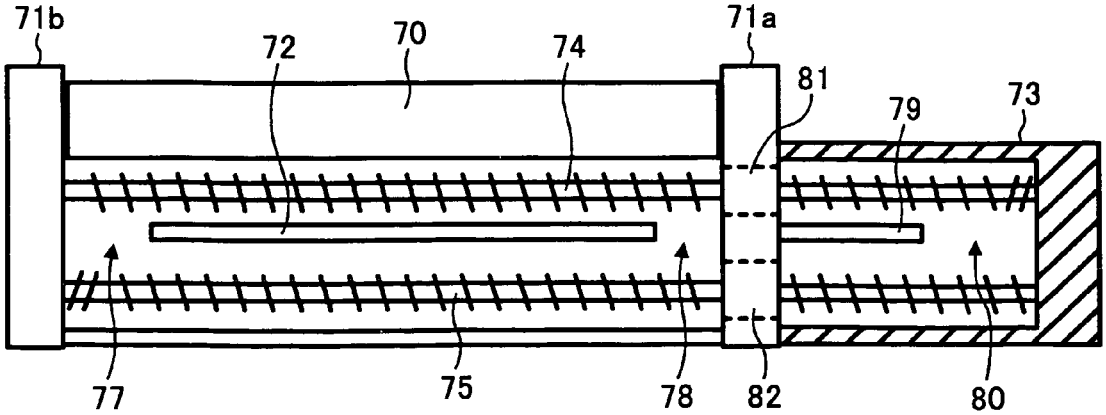
FIG. 5 is an illustration for explaining a flow of the developer in the development unit of FIG. 2.

As illustrated in FIG. 5, the first side portion 71*a* of the housing 71 is provided with a first hole 81 which the first rotary shaft 74 passes through and a second hole 82 which the second rotary shaft 75 passes through. In this example, the second hole 82 has a diameter greater than that of the first hole 81. In addition, the first circulation opening 78 is smaller than the second circulation opening 80.

The first and second rotary shafts 74 and 75 are arranged facing each other in parallel with the first and second partition 72 and 79 in between. The second side portion 71*b* and the outermost side portion of the extended portion 73 have sets of bearings (not shown) for supporting the first and second rotary shafts 74 and 75.

The development roller 70 is arranged next to and slightly above the first rotary shaft 74 and is supported by sets of bearings (not shown) provided to the first and second side portions 71*a* and 71*b*. In addition, the development device 41 is provided with a mixing roller (not shown) under the development roller 70.

The development roller 40, the first and second rotary shafts 74 and 75, and the mixing roller are engaged with each other to rotate together, via gears provided them outside the second side portion 71*b*.

Referring to FIG. 5, a flow of the developer in the development device 41 is explained. For the explanation purpose, a space surrounding the first rotary shaft 74 is referred to as a first space and a space for the second rotary shaft 75 is as a second space. When the first rotary shaft 74 is driven, the developer in the first space is moved in an axial direction towards the first side portion 71*a* along the rotation of the first rotary shaft 74. When the second rotary shaft 75 is driven, the developer in the second space is moved in an axial direction towards the second side portion 71*b* along the rotation of the second rotary shaft 75. That is, the developer inside the first space is flown by the spiral movement of the rotary shaft 74 from the area of the second side portion 71*b* to the area of the first side portion 71*a* and further to the extended portion 73 through the first hole 81. The developer transported inside the extended portion 73 is further moved towards the outermost side portion of the extended side portion 73 and is transported into the second space through the second circulating opening 80. The developer entered into the second space is further transported by the spiral rotation of the second rotary shaft 75 to the beyond the first side portion 71*a* through the second hole 82. The developer traveled through the second hole 82 is further advanced towards the second side portion 71*b* and is eventually returned to the starting point in the first space through the pass-though opening 77. In addition, a part of the developer is moved from the first space to the second space through the first circulation opening 78. In this way, the development device 41 continuously circulates the developer from the first space to the second space to pass along the surface of the development roller 70 in one direction.

The developer supplied through the fill opening 76 is mixed with the carrier and the toner remaining inside the development device 41, in the second space in the extended portion 73. The supplied developer is then transported towards the second side portion 71*b* along the spiral rotation of the second rotary shaft 75 and is entered into the first space through the pass-through opening 77. Thus, the supplied developer is provided to the development roller 70. The development roller 70 transports the developer to the development process and carries back unused portion of the developer to the first space. The returned developer is again circulated through the first and second spaces.

A portion of the development roller 70 held by the first side portion 71*a* is referred to as a downstream edge portion and an opposite portion held by the second side portion 71*b* is referred to as an upstream edge portion. As described above, the circulation passage including the first and second spaces is provided with the first circulation opening 78 in the vicinity of the downstream edge portion of the development roller 70 and the second circulation opening 80 in the vicinity of the edge portion of the first rotary shaft 74 which is beyond the downstream edge portion of the development roller 70. The developer contained inside the development device 41 can be moved from the first space to the second space through the first and second circulation openings 78 and 80. In particular, the developer which usually tends to stay around the downstream edge portion of the development roller 70 in the first space due to the presence of the first side portion 71*a* as a barrier can easily and smoothly escape to the second space through the first circulation opening 78. Thereby, the amount of the developer staying around the downstream edge portion of the development roller 70 is reduced.

As a consequence, the developer is prevented from clogging around an area in the vicinity of the downstream edge portion of the development roller 70 and is smoothly circulated. Thereby, it becomes possible to stably supply the developer to the development roller 70. As a result, an uneven toner density which sensitively appears on an image is prevented.

Extension of the space by the extended portion 73 increases the amount of the developer which lengthens the maintenance cycle of the image forming apparatus, resulting in a reduction of maintenance cost.

The balance of the first and second circulation openings 78 and 80 in size, that is, the first circulation opening 78 is smaller than the second circulation opening 80 is critical. If this balance is set other way around, the main circulation will be made between the first circulation opening 78 and the pass-through opening 77 without conducting a sufficient mixture with the newly supplied developer. As a result, a problem of an uneven toner density will be caused.

In addition, making the distance between the fill opening 76 and the pass-through opening 77 longer is also critical. This is because a sufficient mixture of the newly supplied developer with the existing developer needs a reasonable time. If an insufficiently mixed developer is given to the development roller 70, a problem of an uneven toner density would be caused. Therefore, the development device 41 is provided with the extended portion 73 having the fill opening 76 to mix the newly supplied developer sufficiently with the existing developer.

Further, supplying the developer to the development roller 70 in the way of such a systematic circulation, as described above, is made primarily by dividing the inside space of the development device 41 into the first and second spaced with the first and second partitions 72 and 79. With this structure, a sufficient mixture of the newly supplied developer with the existing developer is achieved.

Although the present invention applies to the image forming apparatus which forms a color image on a recording sheet with black, yellow, magenta, and cyan color toners, and applies two-component type developer including toner and carrier to an image development, it is possible to apply the present invention to other image forming apparatuses which form a black and white image and also those which use a single component type developer including toner.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

This patent specification is based on Japanese patent application, No. 2004-178308 filed on Jun. 16, 2004, in the Japan Patent Office, the entire contents of which are incorporated by reference herein.

What is claimed is:

1. An image forming apparatus, comprising:

a photoconductive member configured to carry an electrostatic latent image thereon; and a development device configured to develop the electrostatic latent image formed on the photoconductive member into a visual image with a developer, the development device including a main housing having first and second side frames facing each other and a first partition for longitudinally dividing an inside space into first and second chambers communicating with each other through first and second openings formed in the first partition near the first and second side frames, respectively;

an extended housing connected to the first side frame of the main housing and having an extension side frame distantly facing the first side frame of the main housing and a second partition continuously formed in line with the first partition for making the first and second chambers of the main housing extended with an extension opening in the second partition near the extension side frame for communicating to the first and second chambers;

a development roller having first and second ends held by the first and second side frames, respectively;

a first rotary shaft having an extended length held by the first and second side frames and the extension side frame, arranged in parallel to and immediately next to the development roller, and configured to rotate to transport the developer along a longitudinal surface of the development roller in a first direction from the second end to the first end of the development roller and to the second chamber through the first opening and the extension opening; and a second rotary shaft having an extended length held by the first and second side frames and the extension side frame, arranged in parallel to the development roller and next to the first rotary shaft, and configured to rotate to transport the developer in a second direction opposite to the first direction and to the first chamber through the second opening, wherein the first side frame includes a first communication portion configured to allow developer to be transported in the first direction from the extended housing to the main housing and a second communication portion configured to allow developer to be transported in the second direction from the main housing to the extended housing.

2. The image forming apparatus of claim 1, wherein the first opening is smaller than the extension opening.

3. The image forming apparatus of claim 1, wherein the extended housing includes a fill opening arranged at an extended position extended outside from the first opening of the main housing and configured to communicate with the first and second chambers and to fill the developer.

4. The image forming apparatus of claim 1, wherein each of the first and second rotary shafts includes a spiral wing for transporting the developer.

5. An image developing apparatus which develops an electrostatic latent image formed on a photoconductive member into a visual image with a developer in an image forming apparatus, the development device comprising:

a main housing having first and second side frames facing each other and a first partition for longitudinally dividing an inside space into first and second chambers communicating with each other through first and second openings formed in the first partition near the first and second side frames, respectively;

an extended housing connected to the first side frame of the main housing and having an extension side frame distantly facing the first side frame of the main housing and a second partition continuously formed in line with the first partition for making the first and second chambers of the main housing extended with an extension opening in the second partition near the extension side frame for communicating to the first and second chambers;

a development roller having first and second ends held by the first and second side frames, respectively;

a first rotary shaft having an extended length held by the first and second side frames and the extension side frame, arranged in parallel to and immediately next to the development roller, and configured to rotate to transport the developer along a longitudinal surface of the development roller in a first direction from the second end to the first end of the development roller and to the second chamber through the first opening and the extension opening; and a second rotary shaft having an extended length held by the first and second side frames and the extension side frame, arranged in parallel to the development roller and next to the first rotary shaft, and configured to rotate to transport the developer in a second direction opposite to the first direction and to the first chamber through the second opening, wherein the first side frame includes a first communication portion configured to allow developer to be transported in the first direction from the main housing to the extended housing and a second communication portion configured to allow developer to be transported in the second direction from the extended housing to the main housing.

6. The image developing apparatus of claim 5, wherein the first opening is smaller than the extension opening.

7. The image developing apparatus of claim 5, wherein the extended housing includes a fill opening arranged at an extended position extended outside from the first opening of the main housing and configured to communicate with the first and second chambers and to fill the developer.

8. The image developing apparatus of claim 5, wherein each of the first and second rotary shafts includes a spiral wing for transporting the developer.

9. A method of image forming, comprising the steps of:

rotating a development roller having first and second longitudinal ends;

circulating a developer with first and second rotary wing shafts through a main circulating loop having a first passage directly facing a circumferential surface of the development roller and a second passage isolated from the first passage by a first partition, the first passage having a first upstream area arranged in a vicinity of the first end of the development roller and a first downstream area arranged in a vicinity of the second end of the development roller, the second passage having a second upstream area and a second downstream area, and the first and second passages communicating with each other between the first upstream area and the second downstream area and between the first downstream area and the second upstream area, the circulating step comprising sub-steps of:

transporting the developer with the first rotary wing shaft from the first upstream area to the first downstream area through the first passage, the first passage including a first communication portion of a first side frame; and returning the developer with the second rotary wing shaft from the second upstream area to the second downstream area through the second passage, the second passage including a second communication portion of a first side frame, bypassing the developer through a bypass loop with extended portions of the first and second rotary wing shafts extended respectively in line in an outward direction from the second end of the development roller from the first downstream area to the second upstream area via a returning area of the bypass loop; and adding the developer into the bypass loop through the returning area.

* * * * *